US005253713A

United States Patent [19]

Gregg et al.

[11] Patent Number: 5,253,713

[45] Date of Patent: Oct. 19, 1993

[54] GAS AND OIL WELL INTERFACE TOOL AND INTELLIGENT CONTROLLER

[75] Inventors: David P. Gregg, New Philadelphia; Lawrence R. Lamp, Millersburg; John G. Corp, Akron, all of Ohio

[73] Assignee: Belden & Blake Corporation, North Canton, Ohio

[21] Appl. No.: 671,459

[22] Filed: Mar. 19, 1991

[51] Int. Cl.[5] ..... E21B 43/12; F04B 47/12

[52] U.S. Cl. ..... 166/372; 166/53; 166/68; 166/70; 417/59; 417/60

[58] Field of Search ..... 166/372, 153, 155, 70, 166/53, 68, 138, 139, 202; 417/60, 59, 58, 57, 56, 555.2; 277/208, 116.4

[56] References Cited

U.S. PATENT DOCUMENTS

| | | | |
|---|---|---|---|
| 2,026,883 | 1/1936 | Gillespie | 277/116.4 X |
| 2,267,902 | 12/1941 | Eddins | 417/60 |
| 2,642,002 | 6/1953 | Knox et al. . | |
| 2,674,315 | 4/1954 | Brown . | |
| 2,674,951 | 4/1954 | Zaba . | |
| 2,714,855 | 8/1955 | Brown . | |
| 2,725,941 | 12/1955 | Henshaw | 277/208 X |
| 2,784,789 | 3/1957 | Otis | 166/138 X |
| 2,791,181 | 5/1957 | Knox . | |
| 2,812,717 | 11/1957 | Brown . | |
| 2,821,142 | 1/1958 | Knox . | |
| 2,830,540 | 4/1958 | Vincent . | |
| 2,838,005 | 6/1958 | Garrett et al. . | |
| 2,838,006 | 6/1958 | Garrett et al. . | |
| 2,878,754 | 3/1959 | McMurry . | |
| 2,884,861 | 5/1959 | Vincent et al. . | |
| 2,937,598 | 5/1960 | Brown . | |
| 2,970,547 | 2/1961 | McMurry . | |
| 3,012,611 | 12/1961 | Haines | 166/147 |
| 3,055,306 | 9/1962 | Tausch . | |
| 3,090,315 | 5/1963 | Milton . | |
| 3,090,316 | 5/1963 | Montgomery . | |
| 3,176,619 | 4/1965 | Shaw . | |
| 3,179,022 | 4/1965 | Bloudoff | 92/252 |
| 3,249,056 | 5/1966 | Lyles . | |
| 3,273,504 | 9/1966 | Lyles . | |
| 3,422,902 | 1/1969 | Bouchillon | 166/202 |
| 3,424,093 | 1/1969 | Moore, Jr. . | |
| 4,070,134 | 1/1978 | Gramling | 417/56 |
| 4,150,721 | 4/1979 | Norwood | 166/53 |
| 4,239,458 | 12/1980 | Yeatts | 417/60 |
| 4,352,376 | 10/1982 | Norwood | 137/624.15 |
| 4,363,606 | 12/1982 | Kilgore | 417/59 |
| 4,449,584 | 5/1984 | Christensen | 166/187 |
| 4,528,896 | 7/1985 | Edwards | 92/242 |
| 4,531,891 | 7/1985 | Coles, III | 417/59 |
| 4,629,004 | 12/1986 | Griffin | 166/372 |
| 4,633,954 | 1/1987 | Dixon et al. | 166/372 |
| 4,685,522 | 8/1987 | Dixon et al. | 166/372 |
| 4,784,222 | 11/1988 | Ford | 166/85 |
| 4,813,485 | 3/1989 | Coyle | 166/372 |
| 4,923,372 | 5/1990 | Ferguson | 417/53 |
| 4,989,671 | 2/1991 | Lamp | 166/53 |
| 5,010,958 | 4/1991 | Meek et al. | 166/202 X |

*Primary Examiner*—Hoang C. Dang

*Attorney, Agent, or Firm*—Fay, Sharpe, Beall, Fagan, Minnich & McKee

[57] ABSTRACT

An interface tool freely slidable within a production pipe or conduit of an oil or gas well capable of creating a positive seal in order to lift liquids and particulates above the device to the surface where they are collected. An internal bypass valve permits the free flow of the particulates and liquids through an internal chamber of the tool during its return descent toward the producing formation. To efficiently utilize the pressure forces of gases trapped below the tool for lifting liquids to the surface when the bypass valve is closed, an elastomeric and expansible cylindrical sleeve is provided encircling a central region of the tool. Both the bypass valve and the elastomeric sleeve are operated by a slidable mechanical push rod received longitudinally within the tool body. The rod is actuated at extreme ends of the production pipe or conduit and detents provide for positive positioning of the rod during ascent and descent of the tool during well operation. A control system monitors conduit pressure and tool arrival to operate a sales valve and a tool release.

39 Claims, 11 Drawing Sheets

FIG.8
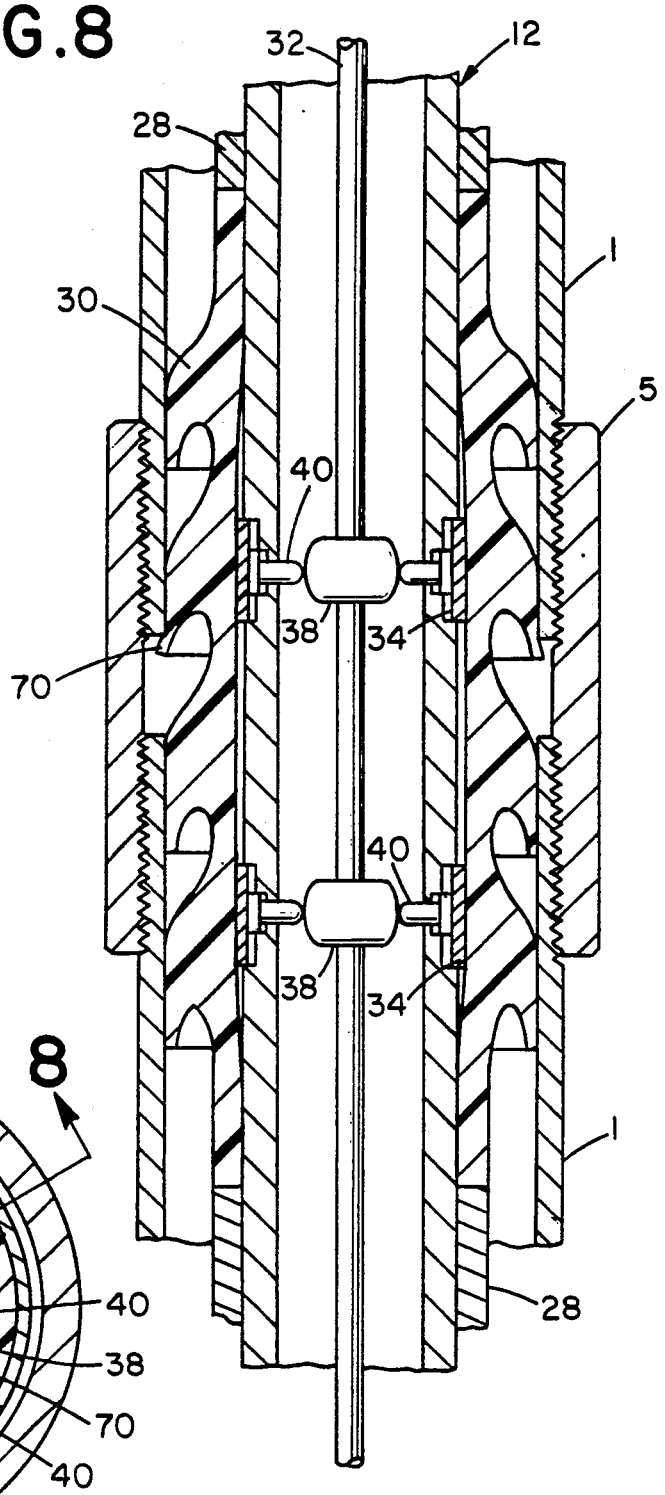
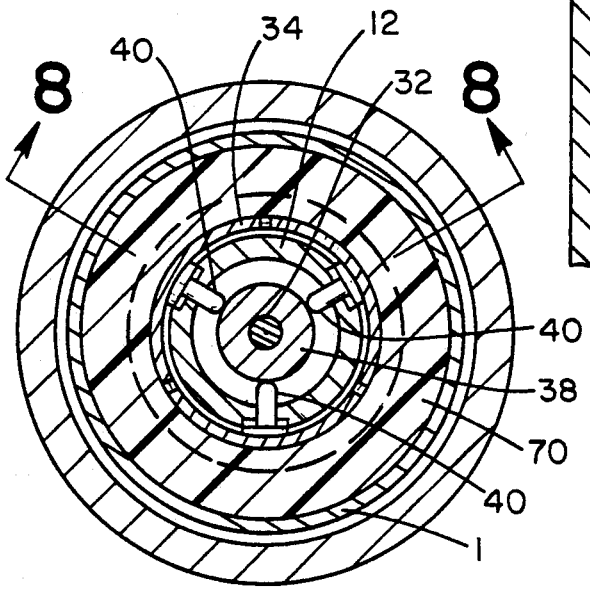
FIG.7

GAS AND OIL WELL INTERFACE TOOL AND INTELLIGENT CONTROLLER

BACKGROUND OF THE INVENTION

1. Field of the Invention

This application pertains to the art of automatic gas and oil wells and, more particularly, to electronically controlled gas and oil wells having a sales conduit or tubing string between a subterranean fluid producing formation and a surface reservoir for storing the fluids produced through the conduit or tubing string.

The invention is particularly applicable to a system employing a plunger or "rabbit" device having a radially expansible portion and an electronic sequencer for controlling the overall gas and oil well system and will be described with particular reference thereto, although it will be appreciated that the invention has broader applications such as swabbing uses and production from wells having a horizontal tubing string made to lie within a narrow producing formation stratus.

2. Description of Prior Art

Production well systems have heretofore comprised a plunger having an elongated and generally cylindrical body portion received into a tubing string surrounded by a casing. The body portion of the plunger is typically provided with a seal for engagement with the inner wall of the tubing string to restrict the flow of fluids around and past the plunger body. Complicated internal valves have been provided within the plunger body to both restrict the flow of fluids through the plunger body itself and to help reduce the free-fall speed of the plunger during its descent from the well head at the surface toward the formation below ground. It is important that the descent speed be held in check due to the deleterious forces generated between the outer seal and the inner conduit wall. U.S. Pat. No. 4,070,134 to Gramling shows such a plunger.

More recently, swabbing systems have been developed using plungers with a radially expansible portion for sealing engagement with a casing responsive to pressure below the plunger and communicated through plunger body orifices beneath the expansible portion. Further, internal valves have been implemented by way of shift rods received axially into the plunger body. U S. Pat. No. 4,813,485 to Coyle shows such apparatus.

Present methods for controlling gas and oil wells using plungers of the type described above involve cyclic operation of the device responsive to pressure differentials above and below the plunger by means of internal pressure sensing apparatus. Plunger catch mechanisms have also been attempted to mechanically catch the plunger at an upper extreme of travel. The plunger is released either by manual means or by an enhanced catch mechanism responsive to pressure differentials within the tubing string and atmosphere. As such, truly automated operation is not possible. It has, therefore, been deemed desirable to provide an economical and efficient solution that meets the various operational conditions encountered at various installations.

SUMMARY OF THE INVENTION

The present invention contemplates a new and improved plunger and control system which overcomes the problems associated with gas and oil well production apparatus using the techniques described above.

According to the present invention, a gas/oil interface tool for efficient extraction of both gas and fluids from a formation is provided.

According to a more limited aspect of the invention, the tool includes an internal valve and an expansible portion for sealing the tubing string of a producing well. Means for mechanically actuating the internal valve is disposed within the tool responsive to the position of the tool within the tubing string.

According to another aspect of the invention, a means for causing the expansible portion to actuate is provided to act in concert with the actuation of the internal valve. Thus, both the expansible portion and the internal valve are made to be responsive to the position of the tool within the tubing string.

According to yet another aspect of the invention, a control system monitors plunger arrival at a catcher apparatus for gripping the plunger during sale of gas. The catcher maintains the plunger in a sales position until the pressure in the tubing string below the tool reaches a predetermined low pressure.

An advantage of the present invention is a simplified well system without the complications associated with traditional "U-Tube" systems which require a separate string of tubing introduced into the casing creating a pressure storage chamber or area between the casing and the tubing allowing the pressure therein to "U-Tube" as the tubing pressure is relieved at the surface.

Another advantage of the present invention is to provide a gas and oil interface tool which has an expansible central region for engagement with the inner walls of a tubing string or other fluid conduits only when expanded, for removal of down-hole liquids which accumulate naturally.

Another advantage of the present invention is a gas and oil interface tool which may be permitted to "free fall" in its descent down-hole in the retracted position, without the deleterious effects associated with frictional contact between the inner walls of the conduit and the flexible and softer seal.

Still yet another advantage of the present invention is the provision of a mechanical assist arrangement for preliminary expansion of the expansible seal portion to allow for early build up of pressure beneath the interface tool urging the seal into more complete contact with the inner walls of the conduit.

Yet still further, another advantage is the provision of an intelligent electronic control device for the ordered sequencing of the gas and oil interface tool within the well head system for more efficient production and recovery of fluids from the formation.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof and wherein similar reference characters denote similar elements throughout the several views, and wherein:

FIG. 7 is an end view of the tool of FIGS. 2A-2C;

FIG. 8 illustrates the mechanical expansion assist device received into the elastomeric band portion of the interface tool which is, in turn, received into a typical conduit joint portion of a gas and oil well;

DESCRIPTION OF THE PREFERRED EMBODIMENTS

Figure 1:
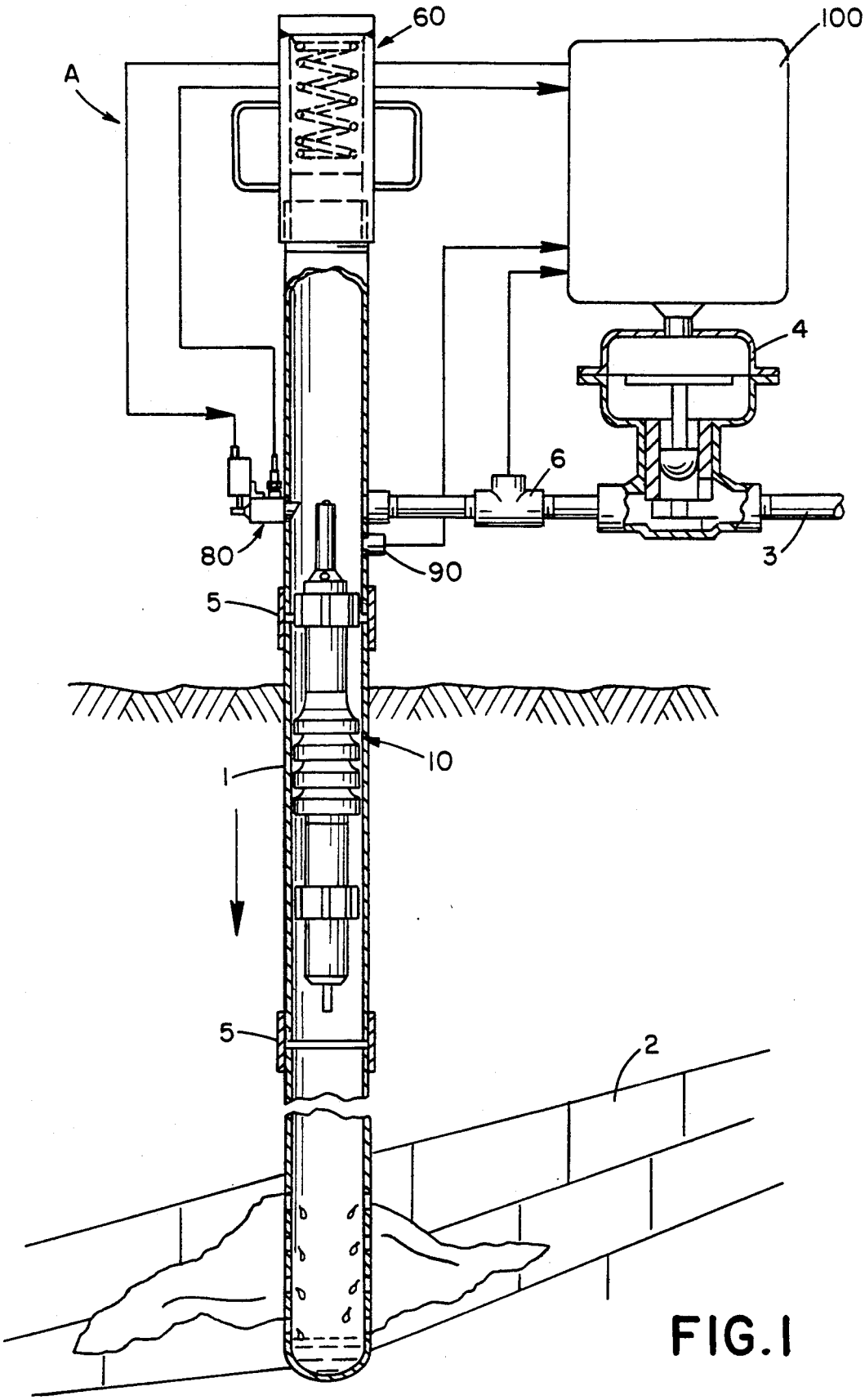
FIG. 1 is a fragmentary and partially cutaway view of a producing gas and oil well installation.

Referring now to the drawings, wherein the showings are for the purposes of illustrating the preferred embodiments of the invention only, and not for the purposes of limiting same, the FIGURES show A GAS AND OIL WELL INTERFACE TOOL AND INTELLIGENT CONTROLLER.

Referring first to FIG. 1, the interface tool 10 is placed within a conduit 1 of a producing gas and oil well A. The conduit 1 may be a narrow tubing string received within a larger and hollow casing, or a simple conduit sized according to the particular application without the inner tubing. The lower end of the conduit 1 is perforated in a region of a producing formation 2 to facilitate the collection of gas and removal of fluids.

Above ground, a plunger trap 80 is provided to appropriately "catch" and hold fixed the interface tool 10 preventing it from descending under the influences of gravity. A lubricator/catcher 60 provides for efficient and non-destructive deceleration of the interface tool 10 under conditions of rapid ascent up conduit 1. A conduit coupling joint 5 is illustrated above ground, however, as one might appreciate, a number of coupling joints are provided underground throughout the length of the conduit 1, the conduit in reality being formed from a number of discrete conduit sections. Also above ground, a pressure switch 90 is provided to generate a pressure switch input signal for use by the intelligent controller 100. Lastly, a safety switch 6 is provided to monitor pressure within the sales line 3.

Fluid flow through the sales line 3 is controlled by a sales motor valve 4, which is in turn responsive to an intelligent controller 100. The intelligent controller 100 executes a stored control program which causes the controller to react to stored operator variables, discrete transducer inputs, and hard-coded variables to efficiently control the producing gas and oil well installation A. The control program is stored in memory contained within the controller 100.

Figure 2A:
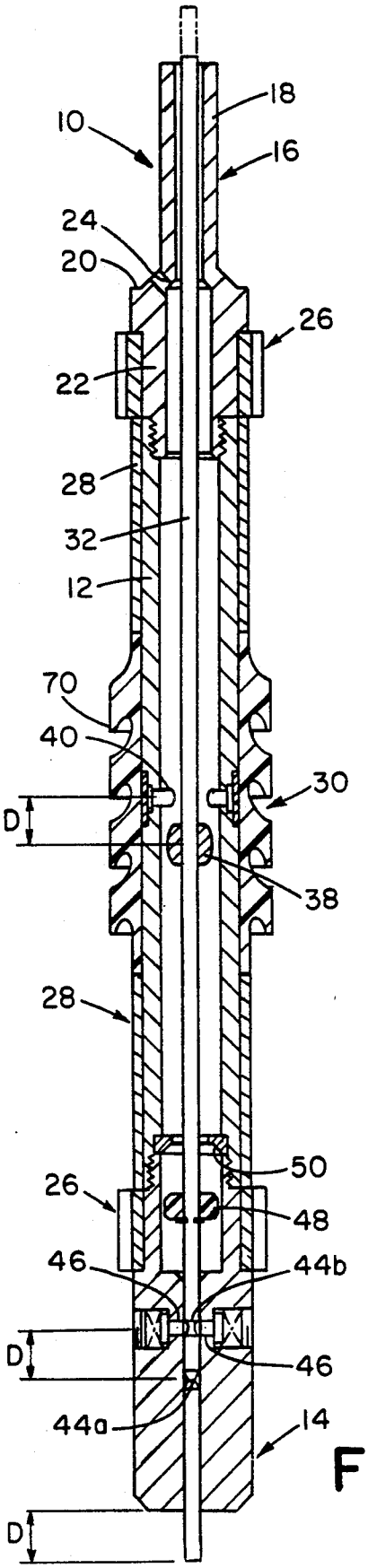
FIG. 2A shows an assembled gas and oil interface tool of an embodiment of the invention.
Figure 2B:
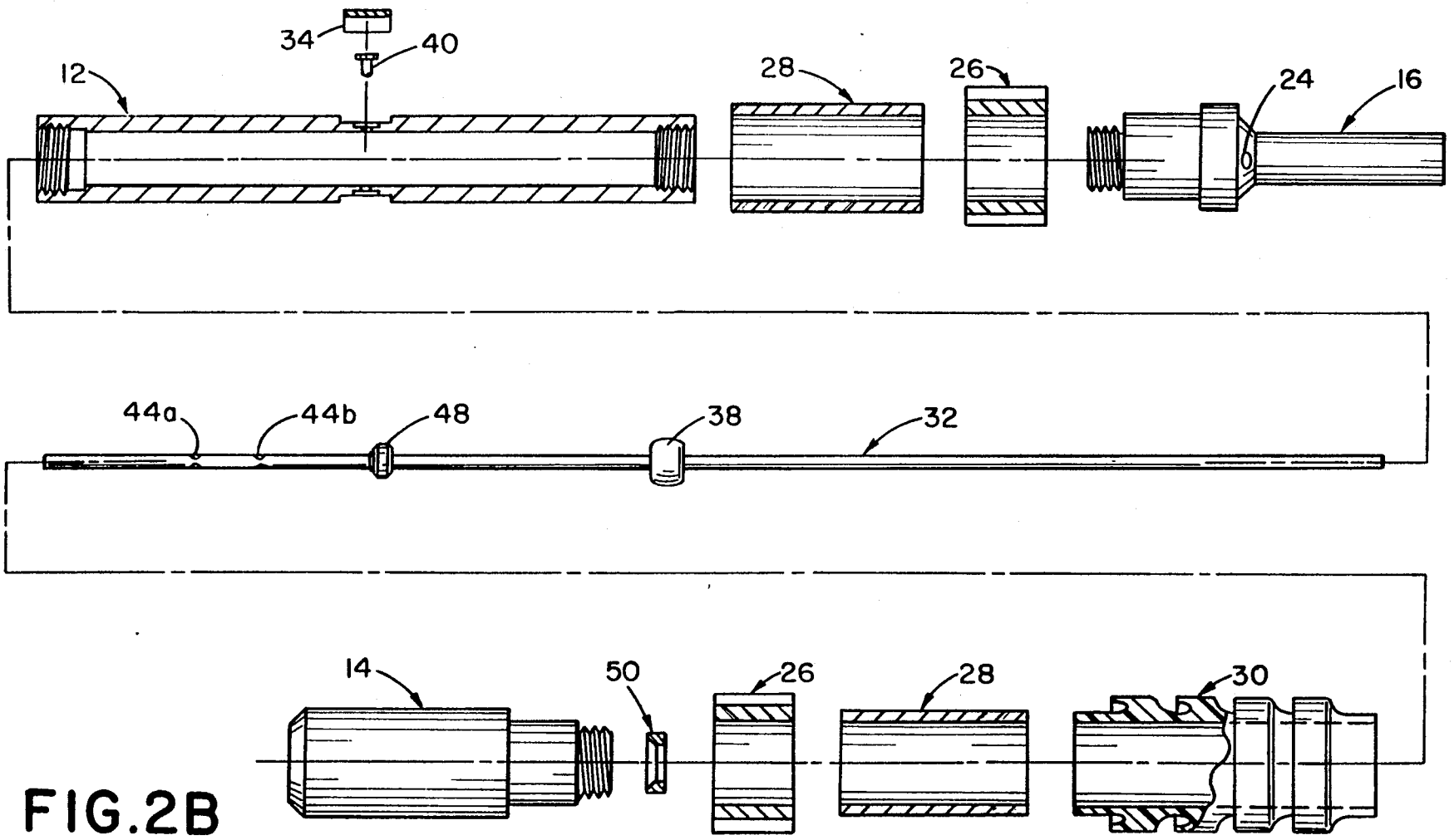
FIG. 2B is an exploded view of the gas and oil interface tool assembly of the embodiment of FIG. 2A.
Figure 2C:
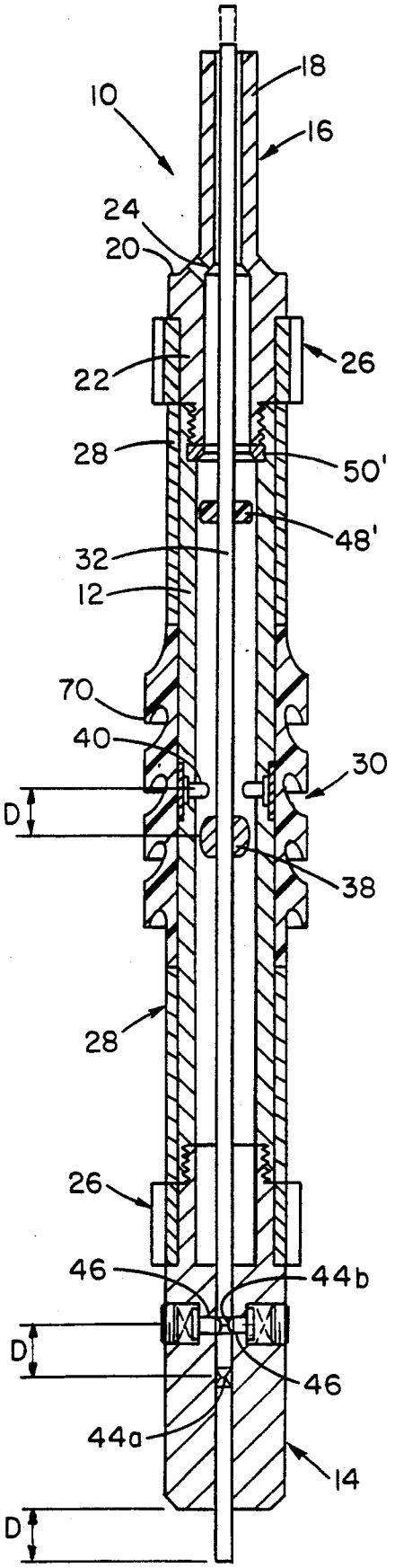
FIG. 2C shows an assembled gas and oil interface tool of a second embodiment.

Referring now to FIGS. 2A-2C, an embodiment of the gas and oil interface tool of the present invention is illustrated. The tool 10 is provided with a hollow main tool body 12, Which threadedly engages a lower tool body portion 14 and an upper tool body portion 16. The upper tool body 16 is provided with a neck 18, a shoulder 20, a head 22, and an upper vent orifice 24. The upper vent orifice 24 provides for fluid communication between regions of the conduit 1 below the tool 10, with regions above the tool 10, through the hollow tool body 12. A pair of centralizers 26 are arranged With respect to the tool body 12 as illustrated to "square" the tool body 10 Within the conduit 1.

As may be appreciated by one skilled in the art, the fluid conduit 1 is typically circular in cross-section, and as such, the tool body 12 and centralizers 26 are similarly shaped in cross-section to allow for slidable ascent and descent in a longitudinal conduit direction. The centralizers 26 are provided for maintaining a predefined distance between the inner wall of conduit 1 and the tool body 12 through contact with the inner wall.

The centralizers 26 are illustrated in FIGS. 2A-2C as being formed in a star-like arrangement, but may take a number of different forms, such as a plurality of wheels having rotational axes arranged about the outer periphery of an annulus formed over the head portion 22 of the upper tool body 16 and similarly below for the lower tool body 14, to engage the inner wall region of the conduit 1 at multiple points. The outer surfaces of the wheels may be suitably coated with nylon, teflon, or other softer composition material so as to reduce the incidence of scratching the inner walls of conduit 1. Likewise, the centralizers 26 illustrated in FIGS. 2A-2C may themselves be wholly formed of similar materials or be coated with similar non-scratch composition in contact-prone areas. Strips of teflon or other softer composition materials may be attached to the outer peripheral edges of the centralizers 26. In order to dispose with the star-like centralizers 26, strips of non-scratch material may be attached directly to the spacers 28 or the upper tool body 14 and lower tool body 16 in a longitudinal direction.

Along those lines, the tool 10 may be formed having an overall length selected to correspondingly match the turn radius of a conduit used in conjunction with horizontal conduit sections received into a narrow horizontal formation. The tool may be constructed of material having sufficient density to build up a large amount of inertial energy during descent to continue on a horizontal or slightly below horizontal path through the formation. The addition of wheels to the centralizers 26 along with the absence of frictional contact between the retracted expansible portion 30 with the conduit walls and corresponding loss of inertial energy, provides for use of the tool so configured in the above application.

With continued reference to FIGS. 2A-2C, an actuator rod 32 is received in the interface tool 10 for slidable longitudinal motion within the tool body 12. The actuator rod 32 is provided with detent pairs 44*a* and 44*b* which are formed to interact with a pair of opposing and spring-loaded detent pins 46 for holding the actuator rod 32 in one of two predetermined positions.

Functionally, when the tool 10 reaches the well bottom after its descent through conduit 1 with the rod 32 in the position shown in FIGS. 2A and 2C, the actuator rod 32 strikes the well bottom first as it extends from the tool 10 by a distance D. The inertial mass of the descending tool body 12 and the other components comprising the assembled tool 10, forces the actuator rod 32 in contact with well bottom, to a first position and held there by detents 44*a*. When the rod 32 is in this position, the seal element 48 engages the seat 50 and the expansible portion 30 expands radially under the influence of the expansion drive 38. In this profile, the tool 10 effectively "plugs" the conduit against the natural forces of the formation below.

As the tool 10 is forced upward through conduit 1 by the forces of the gas pressure building below, the actuator rod 32 remains held firmly in place by the opposing detent pins 46 at the first position defined by detents 44*a* and by the pressure below the seal element 48 against the seat 50. Upon reaching the lubricator/catcher 60, the actuator rod 32 is forced into a second position and held in that position by the detent pins 46 received into detents 44*b* as shown in FIGS. 2A and 2C. The actuator rod 32 thus operates within the interface tool 10 between two extreme positions as defined by detents 44*a* and 44*b*.

Still referring to FIGS. 2A–2C, the interface tool 10 is assembled according to the sequence described below. The relay pins 40 and the expansion plates 34 are first installed on the tool body 12. The expansible portion 30 is then slid over tool body 12 and located in a central region of the tool body 12. A pair of spacers 28 are next telescopically slid over the tool body 12 on either end of the expansible portion 30. Next, a first centralizer 26 is slipped over head 22 of upper tool body 16 and a second centralizer 26 is slipped over a suitably adapted region of the lower tool body 14. The actuator rod 32 is then slid into the tool body 12. Lastly, the upper tool body 16 with the centralizer 26 received thereon is threaded into an end of the tool body 12, and similarly the lower tool body 14 having a centralizer 26 received thereon is threaded into the tool body 12 at the other end.

Still referring to FIGS. 2A–2C, the actuator rod 32 is formed having an outer diameter substantially less than passageways formed within the upper tool body 16, the tool body 12, and the lower tool body 14 to allow for the flow of fluids through the center of the interface tool 10 and around the actuator rod 32. An upper vent orifice 24 is provided in the upper tool body 16 for the free-flow of fluids past the shoulder 20 and neck 18 portions of upper tool body 16. A seal element 48 is fixedly attached to the actuator rod 32. The seal element 48 is made to engage seat 50 formed in the lower tool body 14 as shown in FIG. 2A. When the seal element 48 is engaged with the seat 50, flow of fluids through the hollow tool body 12 is thereby restricted. Detents 44*a* hold the actuator rod 32 in a fixed position during the ascent of the interface tool 10 within the conduit 1, which overall operation will be described below. At that time, the fluid flow through the tool 10 is restricted by the seal element 48 engaged with the seat 50. Alternately, when the actuator rod 32 is held in the second position by detents 44*b*, the seal element 48 is held away from the seat 50 to permit the free flow of fluids through the tool body 12 and out through the upper vent 24 during the sale of gas and also during the descent of the interface tool 10 within the conduit 1.

In another embodiment shown in FIG. 2C, the upper tool body 16 may be modified to define the seat 50' near the threaded region received into the tool body 12. Correspondingly, the seal element 48' is moved toward the upper tool body end to engage the seat 50' when the rod 32 is held by detent pins 46 in detent pairs 44*a*. In this way, pressure below tool migrates through the lower tool body 14 and into the tool body 12 causing the expansible portion 30 to further expand against the inner wall of the conduit 1 to enhance the seal therebetween.

The expansible portion 30 of the interface tool 10 is made to expand radially within the conduit 1 urged first by the mechanical action of the expansion drive 38 upon reaching the bottom of the conduit 1 when the actuator rod 32 is made to shift longitudinally within the tool body 12 into detents 44*a*. The expansible portion 30 may be further urged into radial expansion by fluid pressure developed below the interface tool 10 by the formation 2 in the alternative embodiment shown in FIG. 2C. The expansion drive 38 forces relay pins 40 to extend radially against the resilient force of the elastomeric layer 70, in turn urging it into contact with the inner wall of the conduit 1 to establish a first sealing force against the flow of fluids past the interface tool 10 within the conduit 1. In the alternative embodiment, as pressure builds beneath the interface tool 10, so too does the pressure Within the tool body 12 because of the clearance provided between the actuator rod 32 and the lower tool body 14. Further expansion of the expansible portion 30 is thus effected to better seal against the flow of fluids past the interface tool 10.

As shown in FIG. 2A, the expansible portion 30 has a cross-sectional area less than that of the pair of centralizers 26, which in turn are smaller in cross-section than the conduit 1 itself. In the preferred embodiment, the outer diameter of the centralizers 26 are about three and seventy eight hundredths inches (3.78") in overall outer diameter. By this sizing, the outer surface of the expansible portion 30 is prevented from contacting the inner walls of the conduit 1 during the descent of the interface tool 10. Other centralizer diameters may be selected for various sizes of conduit to provide a centralizer within tolerance of the conduit inner diameter. Upon reaching the lower extreme travel limit through the conduit 1, the interface tool 10 seals the conduit by simultaneously closing an internal valve formed as the seat element 48 engages the seat 50 and an external valve formed as the expansible portion 30 expands radially, urged by the expansion drive 38 connected to the actuator rod 32.

Figure 3:
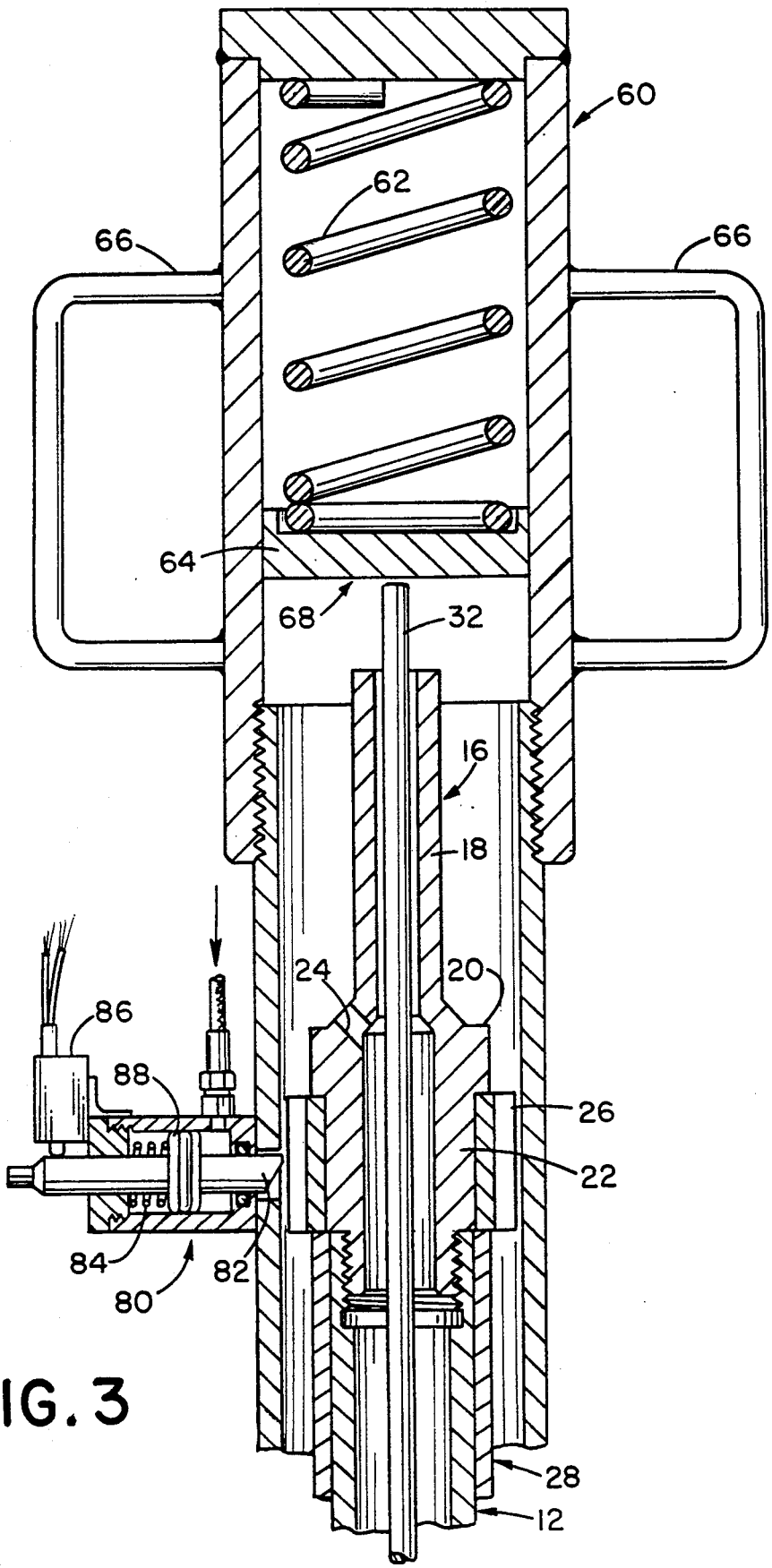
FIG. 3 illustrates a lubricator for use in conjunction with a gas and oil well installation using the interface tool illustrated in FIG. 2A-2C.

Referring now to FIG. 3, the lubricator/catcher 60 is illustrated having a spring 62, an actuator rod landing zone 68, a slidable plate 64, and grips 66. The actuator rod landing zone 68 is made to engage the uppermost end of the actuator rod 32 and tool body 16 as the interface too) 10 reaches the uppermost extreme end of travel of the conduit 1. The amount of rod 32 extending from the upper body 16 is predetermined to correspondingly match the distance between the pair of detents 44*a* and 44*b*. In this way, the actuator rod 32 is made to shift longitudinally within the tool body 12 between a first position defined by detents 44*a* and a second position defined by detents 44*b* engaging the detent pins 46 in each instance. The spring 62 is provided of sufficient length and having a spring constant adequate to absorb the kinetic energy of the interface tool 10 to cause the tool to appreciably decelerate so as to reduce the wear on the overall system due to impact forces. The spring constant of spring 62 may be selected for a particular application to both dampen the "catching" of the interface tool 10 while yet allowing the upper tool body 16 to engage the plate 64 for a complete stroke of the actuator rod 32. A pair of grips 66 are provided for removal of the lubricator/catcher 60 from the upper end of the conduit 1 for servicing.

In practice, the spring length is selected so that no pressure is applied to the upper tool body 16 through plate 64 when held in place by the catch pin 82. In other words, the catch pin 82 need only support the weight of the tool 10 during sales of gas. In the FIGURE, the tool is shown as having just impacted the landing zone 68 of plate 64 with the actuator rod 32. With sufficient inertia, the tool body 10 "swallows" the rod 32 and continues on to strike the plate 64 with neck 18. At a point in time when the tool body 16 meets the landing zone 68, the detent pin 82 extends to trap the tool in position for sales of gas. In the position shown, the ramped pin is forced into retraction activating switch 86. The plate 64 may be perforated to discourage pressure differentials during plate motion.

Figure 4:
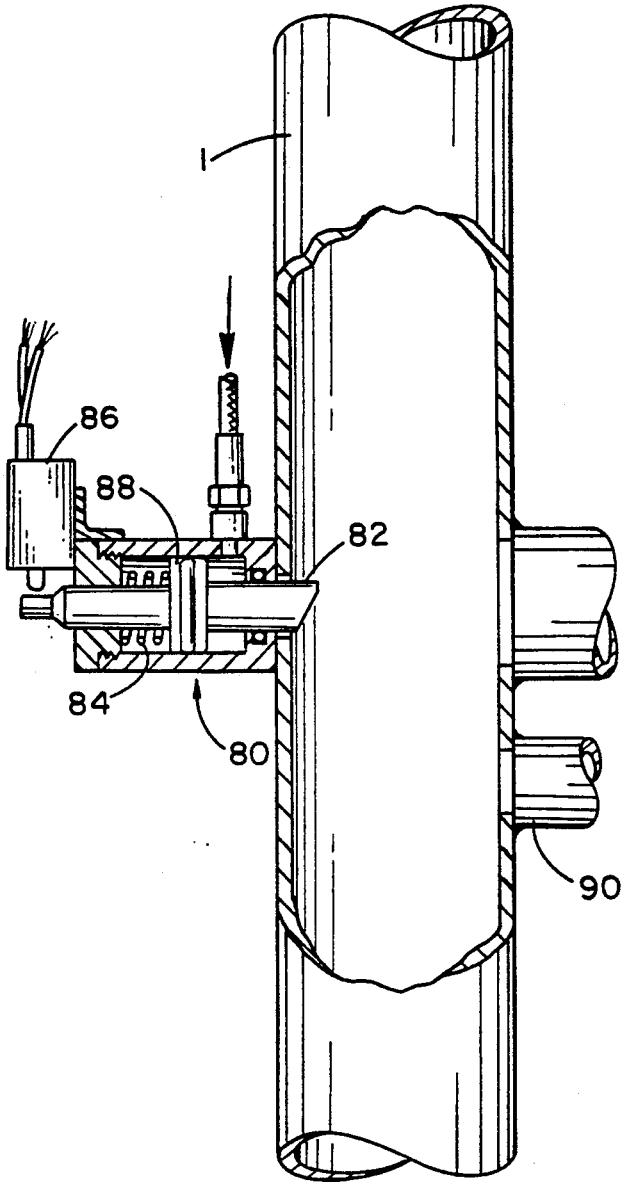
FIG. 4 shows a catcher for use with a gas and oil well using the interface tool of FIGS. 2A-2C.

Referring now to FIG. 4, a plunger trap 80 is shown for alternately holding and releasing the interface tool 10 responsive to commands from the intelligent controller 100. The plunger trap 80 is provided with a tapered catch pin 82 slidably received within the plunger trap 80. The catch pin 82 is biased in the position shown in the FIGURE by an internal spring 84. A catch pin retractor 88 responsive to the intelligent controller 100 is provided to motivate retraction of the catch pin 82 allowing the interface tool 10 to descend within the conduit 1 urged by the force of gravity. A catch pin retracted switch 86 is provided for generating an appropriate signal to the controller 100 when the catch pin 82 is in a retracted position, as when the tool 10 contacts the ramp portion of the pin 82 driving it into the plunger trap 80. A pressure switch 90 is preferably provided down-hole from the plunger trap 80 by about the length of the interface tool 10. In that Way, the pressure switch 90 senses pressure in the conduit even when the interface tool 10 is held in place by the catch pin 82 during sale of gas.

Figure 5B:
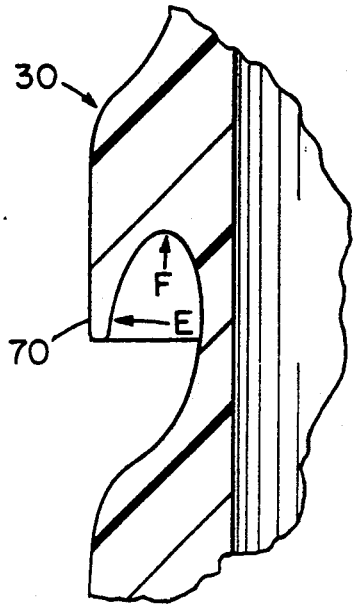
FIGS. 5A and 5B are detailed views of the elastomeric band portion of the interface tool of FIGS. 2A-2C.
Figure 5A:
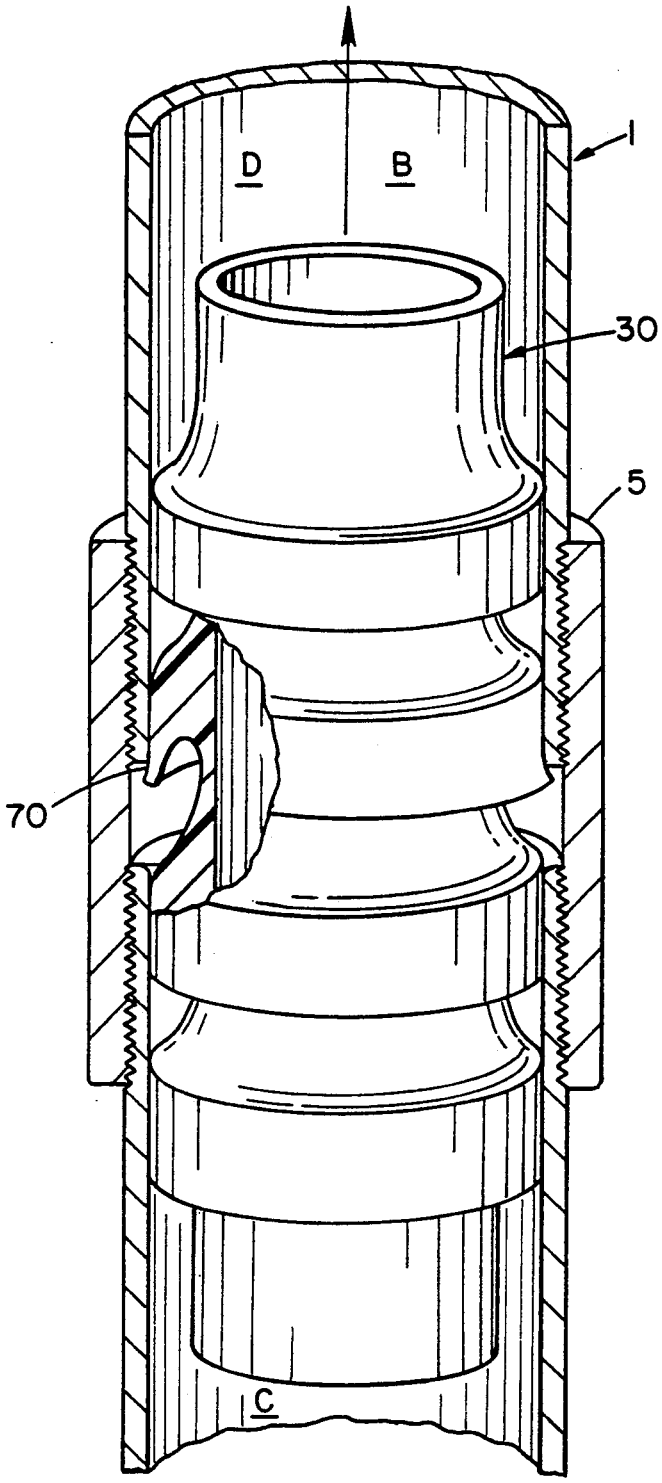

Referring now to FIGS. 5A and 5B, the outer elastomeric seal 70 of the expansible portion 30 is illustrated as a series of circumferential and downwardly disposed grooves to effect a seal between the interface tool 10 and the inner walls of the conduit 1 due to pressure in a region C below the expansible portion 30 provided with the elastomeric seal 70 illustrated in the FIGURE. As the pressure in the region C increases and exceeds the pressure in the region D, the circumferential concave grooves within the elastomeric seal 70 are urged in directions E and F. Pressure forces in a direction E tend to seal portions of the elastomeric seal 70 against the inner walls of the conduit 1. Forces in the direction F urge the elastomeric seal 70 received over the interface tool 10 in the expansible portion 30 in a direction B for ascent within the conduit 1. Further, as the pressure above the tool in the region D is relieved as by opening the sales valve 4, the pressure differential between regions C and D force the tool to ascend the conduit, in effect "pushing" fluids accumulated above along toward the surface.

The repeated pattern of circumferential concave grooves formed in the elastomeric seal 70 provides for the efficient sealing of the expansible portion 30 when the interface tool 10 passes through a region connected by a coupling point 5. As the elastomeric seal 70 passes through the coupling joint area, an efficient seal is maintained by a first expandable region above the coupling joint void in engagement with the inner walls of the conduit 1. A second expandable region below the coupling joint is also held in engagement with the inner walls. This arrangement allows for continuous, uninterrupted integrity of the seal to eliminate "blow by" and the commensurate loss of system efficiency.

Figure 6A:
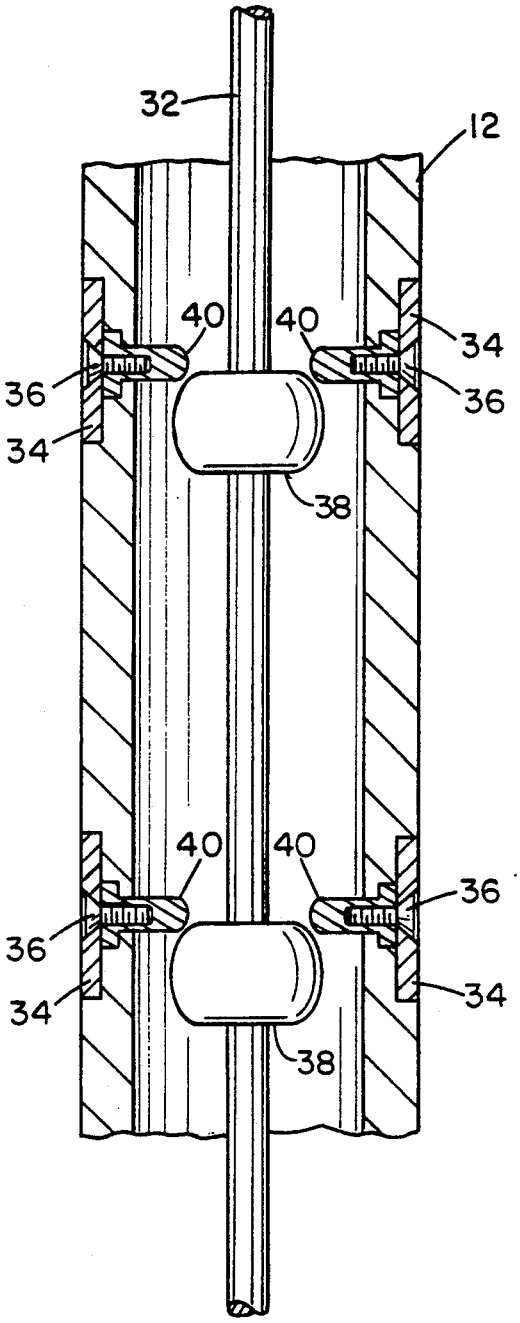
FIGS. 6A and 6B illustrate the internal mechanical expansion assist device of the interface tool in a retracted and expanded position, respectively.
Figure 6B:
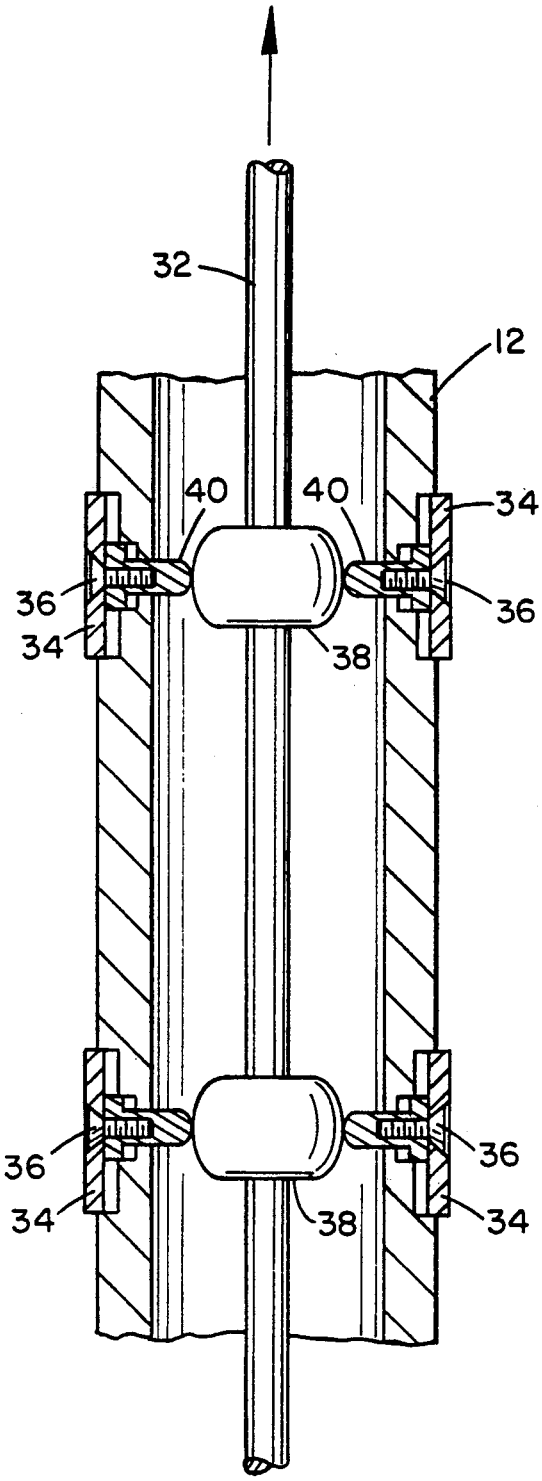

Referring now to FIGS. 6A and 6B, the mechanical expansion device is shown in a retracted and expanded position, respectively. The FIGURES show an actuator rod 32, expansion plate 34, connector pin screws 36, a pair of expansion drives 38, relay pins 40, and an outer housing 12 comprising a part of the tool body. The mechanical expansion device shown in FIGS. 6A and 6B is received into the elastomeric collar 70 as shown in FIG. 8. As described above, the actuator rod 32 is slidable within the tool body 12, which slidable action tends to urge the expansion plates 34 in an outward axial direction within the conduit 1 forcing the elastomeric seal 70 against the inner walls of the conduit 1.

For simplicity, the tool of FIGS. 2A–2C is shown having a single expansion drive 38, although it is to be appreciated that more than one may be used, as for example shown in FIGS. 6A and 6B. Selection of the number of expansion drives used is based upon overall length of the tool and other application specific factors. Also, it is noted that the implementation of multiple singular expansion plates as shown in FIGS. 6A and 6B may be substituted with fewer but longitudinally longer plates made to span the distance between the upper and lower drive pins. Indeed, the arrangement of FIGS. 6A and 6B may be equivalently replaced with a single expansion drive 38 and a single long expansion plate. Radially expandable bands may also be used in lieu of the plates 34 to provide for a similar distributed force against the elastomeric seal 70.

The retracted position of FIG. 6A shows that the expansion drives 38 engage the relay pins 40, but without forcing the expansion plates 34 into radial expansion. Each expansion plate 34 is anchored to a relay pin 40 by means of a connector pin screw 36. In the expanded position shown in FIGS. 6B and 8, the expansion drives 38 are made to pressure the relay pins 40 outward in an axial direction thereby forcing the expansion plates 34 outward against the resilient force of the elastomeric seal 70 normally biased in the nonexpanded profile.

The FIGURES illustrate the expansion plates 34 as being slidable within the tool body 12 to provide for uniform pressure over the length of the elastomeric seal 70 received over the tool body 12. As FIGS. 6A and 6B show a cross section of the mechanical expansion device, only two-thirds of relay pins 40 are illustrated. Any number of relay pins may be provided extending radially from the central axial axis of the interface tool 10 as illustrated in FIG. 7 wherein a set of three (3) cooperative relay pins 40 are shown. The tool body 12 is cylindrical in shape with the expansion plates 34 received therein for slidable axial motion.

Referring now to FIG. 7, the elastomeric seal 70 is shown received over the mechanical expansion device of FIGS. 6A and 6B. Beginning from the center of FIG. 7, the expansion drive 38 is shown in cross-section as being of annular form. The expansion drive 38 is fixedly attached to the actuator rod 32. The relay pins 40 are received into the tool body 12, each relay pin 40 being spaced one hundred twenty degrees (120°) from the remaining two pins. Although three relay pins 40 are illustrated in the figure, any number of relay pins may be used as dictated by each particular application. The relay pins 40 are axially slidable Within the tool body 12 under the influence of the action of the expansion drive 38 forcing the pins 40 outward and the elastomeric seal 70 forcing the pins inward. Fixedly attached to each relay pin 40 is an expansion plate 34 by means of a connector pin screw 36. As the actuator rod 32 shifts longitudinally within the interface tool 10, the expansion drives 38 force each of the three relay pins 40 outward in an axial direction to force each of the expansion plates 34 outward. The elastomeric seal 70 received over the tool body 12 is thereby made to flex radially outward at discrete contact points defined by the expansion plates 34. As may be appreciated by one of ordinary skill in the art, the expansion plates 34 may extend longitudinally for a distance greater than that between the two expansion drives illustrated in FIGS. 6A and 6B. In effect as indicated above, the two expansion plate pairs 34 shown in FIGS. 6A and 6B could be reduced to one pair of longer expansion plates, each of the plates of the pair being contacted and influenced by two relay pins 40.

Referring now to FIG. 8, the mechanical expansion device is shown received into the elastomeric seal 70. Further, the elastomeric seal 70 is shown within the conduit 1 at a coupling joint 5. As illustrated, spacing between the expansion drives 38 is selected such that mechanical engagement forces are established both above and below the gap in the conduit sections 1 formed at the coupling joints 5. As described above, the elastomeric seal 70 comprises multiple rib portions for sealing the conduit 1 both above and below the coupling section 5. An effective seal is provided through the combination of the multiple ribs of the elastomeric seal 70 and the distance selected between the multiple expansion drives 38.

Figure 9:
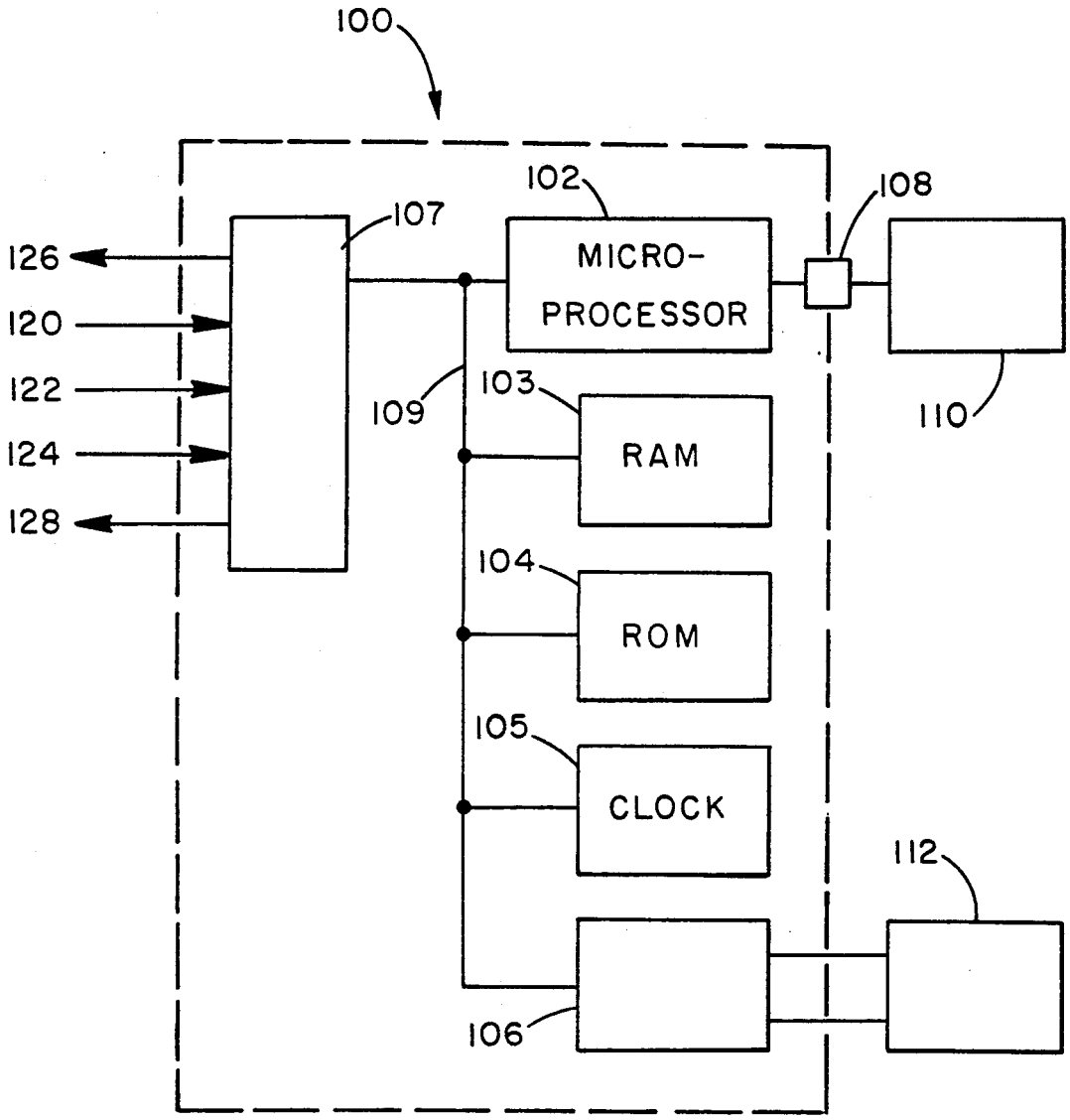
FIG. 9 illustrates an embodiment of the well head control system of the invention; and, FIGS. 10A and 10B are flow-charts of the well head control system.

Referring now to FIG. 9, the intelligent controller 100 is illustrated. Within the intelligent controller 100 is a microprocessor 102, RAM 103, ROM 104, a clock circuit 105, a power supply 106, an input/output buffer circuit 107, an input/output communication interface 108, and a network circuit 109 for electrically connecting the above. The microprocessor 102 executes instructions stored in ROM 104 using the RAM 103 for temporary storage of variables and the like. Operator selectable variables may also be stored in RAM 103 along with performance data obtained through monitoring the gas and oil well head system A. A hand held terminal 110 or any other operator interface having a key pad input and/or a display output is provided for communication with the intelligent controller 100 through input/output communication interface 108. The input/output communication interface 108 may be serial and/or parallel. The hand held terminal 110 is provided for inputting operator selectable variables and polling for status of the intelligent interface controller 100. A printer or modem may be provided in place of hand held terminal 110 to extract performance data stored in RAM 103, which performance data may chart the history of the well head insulation A for extended periods of time.

The intelligent controller 100 is provided with a solar panel 112 for maintaining a charge on the power supply 106. The power supply may be a rechargeable battery or the like. The input/output buffering circuit 107 electrically interfaces the control circuitry within the intelligent controller 100 with the outside world.

For a well head installation A using the interface tool 10, the discrete I/O points necessary for control are minimized. The inputs comprise essentially a catch pin retracted input signal 120 generated by the switch 86 (FIG. 1), a conduit pressure input signal 122 generated by a pressure transducer 90 (in FIG. 1), and a safety input signal 124 generated by safety switch 6 (FIG. 1). The output signals comprise essentially a catch pin retract signal 126 for actuation of the catch pin retractor 88 (FIG. 4) and a sales valve open signal 128 for opening the sales valve 4 to allow fluids to flow through sales line 3 (FIG. 1).

Figure 10A:
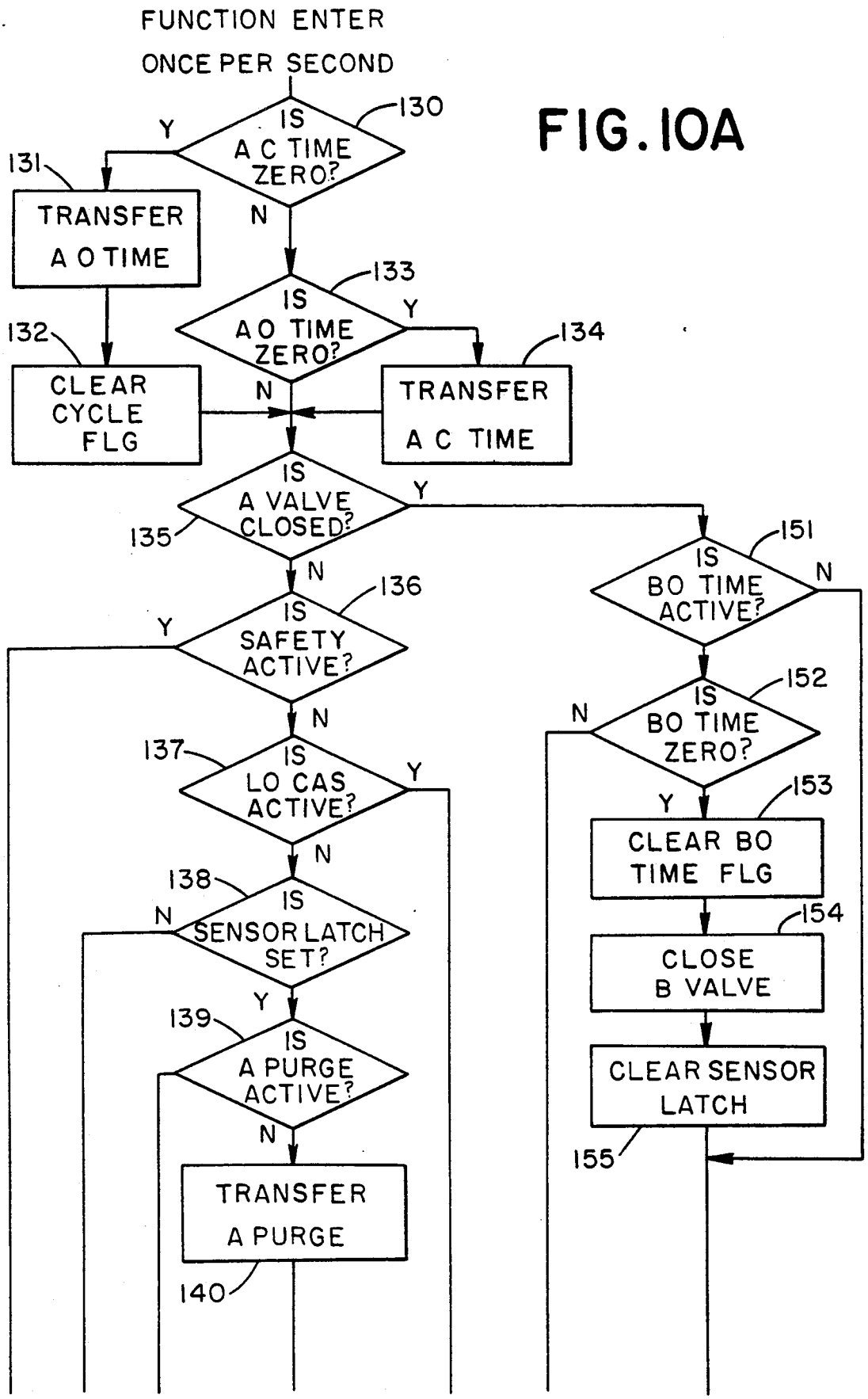
Figure 10B:
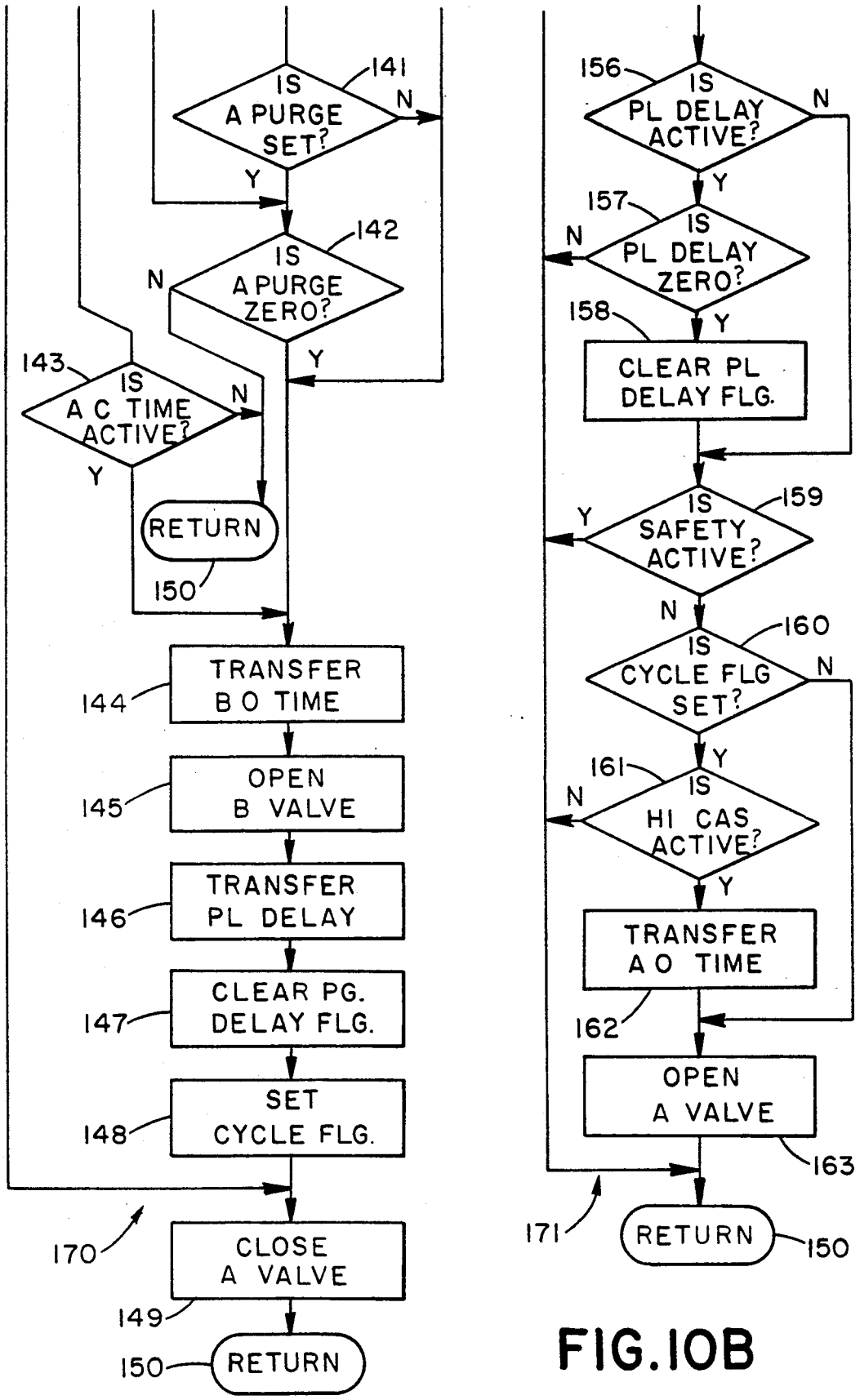

Referring now to FIGS. 10A and 10B, the control algorithm flow executed by the controller 100 will be described. The intelligent controller 100 is left in a "sleep" mode until activated by an interrupt initiated once every second by the clock circuit 105. By this Way, the energy stored in the power supply 106 is conserved. The control algorithm diagramed in FIGS. 10A and 10B is entered once for every "wake up" interrupt (once every second). The time period selected between "wake-ups" may be selected for each particular application, but in general, a one second (1 sec.) time period is adequate to both conserve energy stored in power supply 106 and to monitor physical events at the installation.

Before the control algorithm is executed, various housekeeping routines are executed including the maintenance of the various internal timers used with the controller. The internal timers operate such that when a time value is transferred by the control algorithm, that value is made to successively count down each time the house keeping routines are called. In the preferred embodiment, the control "wakes up" once per second, but the duty cycle may be adjusted for a particular application. After the timer values are transferred, they are counted down until "zero", at which time a flag is set by the house keeping function indicating that a particular timer has reached "zero". These flags are available for use by the control algorithm shown in FIGS. 10A and 10B.

The control algorithm first checks the sales valve closed time for a zero value 130, then checks the sales valve open time for a zero value 133. If the sales valve closed timer has zeroed, a sales valve open time is transferred 131 and the cycle flag is cleared 132. If the sales valve time has zeroed 133, the sales valve closed time value is transferred in step 134. Algorithm step 135 determines whether the sales valve is presently held in an open or closed position. If the sales valve is opened, a first control algorithm leg 170 is executed. In general, the first leg 170 is executed during the sale of gas, both during the ascent of the tool 10 up the conduit 1 and during the time when the tool is held by the plunger trap 80. However, if the sales valve is closed, a second control algorithm leg 171 is executed. In general, the second leg 171 is executed during the shut-in period, both during the descent of the tool 10 down the conduit 1 and during the time when the tool 10 is down-hole as the pressure builds from the formation 2.

When the sales valve is determined to be opened 135, the safety input signal 124 is first checked in step 136. If the safety input signal is determined to be active, the sales valve 4 is closed in step 149, effectively shutting in the well. The safety input signal may be used to reflect an abnormal condition in sales line pressure, a fluid reservoir filled to capacity, or the like. Multiple safety sensors may be logically combined in a fail-safe configuration to monitor more than one system parameter. The pressure switch input signal 122, generated by the pressure transducer 90, is tested in step 137 to determine whether the casing pressure is at a predetermined low value. In the preferred embodiment, the predetermined low conduit pressure is selected as being one hundred, fifty pounds per square inch of pressure (150 psi). If the conduit pressure is not at or below the low value, the sensor latch switch flag is tested at step 138. The sensor latch flag is set when the catch pin input signal 120 transitions between logic levels, generating an interrupt, at which time the sensor latch flag is set. The input signal 120 is driven by the catch pin retracted switch 86. If the sensor latch flag is not set, the sales valve closed time is tested and if not active, the control algorithm returns 150 to the calling function. If the sales valve closed time is active, the latch valve open time is transferred 144. The latch valve controls the catch pin retractor 88 to release the interface tool 10 into the conduit 1 for descent below the surface under the influence of gravity.

If the sensor latch flag was set, a purge active flag is tested 139, and if active and not yet zero 142, the control algorithm returns 150 to the calling program. The purge delay is an operator controlled variable stored in the RAM 103 of the intelligent controller 100. The sale of gas from the conduit 1 through the tool body 12 and upper vent 24 to the sales line 3 occurs during the purge delay. The conditional block 141 tests whether an operator has set a selectable purge delay time. When the purge delay has timed out if set 142, or if not set 141, the latch valve Open time value is transferred 144, and the latch valve is opened 145. The effect is to drop the interface tool 10 into the conduit 1 under the influence of gravity. Finishing the first algorithm leg 170, the controller transfers a plunger delay time value 146, clears the purged delay flag 147, sets the cycle flag 148, and lastly, lowers the sales valve open signal 128 effectively closing the sales valve 4.

With the sales valve 4 closed, the second leg 171 of the control algorithm is executed. The latch valve open time is first tested in conditional block 151, the latch valve open time being transferred in step 144. If the latch time open is yet active 151 and timed out 152, the latch valve open time flag is cleared 153 the catch pin retract signal 126 is lowered closing the latch valve 154 and the sensor latch flag stored in the RAM 103 is cleared 155.

The conditional block 156 tests whether the operator has selected a plunger delay and if so, the delay counter is tested 157 and when zero the plunger delay flag stored in the RAM 103 is cleared 158. During the operator selectable plunger delay, the interface tool is permitted to descend from above the surface to the formation 2. The delay time is selected to ensure that the tool 10 completes its descent down-hole regardless of Whether the pressure transducer 90 senses a high pressure indicative of the installation's preparedness to sell gas and fluids.

The safety input signal 124 is tested in conditional step 159 and if active, the control algorithm returns 150 to the calling program. In general, as long as the safety input signal 124 is active (logical false for fail-safe operation) the sales valve 4 is maintained in the closed position effectively "shutting in" the well head system A. The pressure input signal 122 is tested in conditional step 121 and when the signal indicates pressure within the conduit 1 at a predetermined high level, the sales valve open time is transferred 162, and the sales valve open signal 128 is raised 163 effectively opening the sales valve 4. In the preferred embodiment, the predetermined high conduit pressure is selected as being three hundred pounds per square inch of pressure (300 psi). At this time, the interface tool 10 ascends from near the formation 2 to above ground bringing with it the fluids accumulated above the tool during descent, along with gases within the conduit 1 through the sales line 3.

The invention has been described with reference to the preferred embodiments. Obviously, modifications and alterations will occur to others upon a reading and understanding of this specification. It is our intention to include all such modifications and alterations insofar as the come within the scope of the appended claims and equivalents thereof.

Having thus described the invention, we claim:

1. A valving member for use with a well producing fluids under pressure through a production conduit having an inner wall, the member comprising:

a body slidable within the production conduit, the body having a longitudinal axis, a transverse radial axis orthogonal to the longitudinal axis, and an internal passageway;

a radially expansible sealing means attached to the body for selectively i) circumferentially contacting the inner wall of said production conduit to seal against a first flow of said fluids between the body and the inner wall when expanded and ii) avoiding contact of the inner wall of said production conduit when contracted allowing said first flow;

bleeder means for permitting a second flow of said fluids through the internal passageway when in an opened position, and for restricting the second flow of the fluids through the passageway when in a closed position;

bleeder control means for selectively disposing the bleeder means into the closed position when the body is at a first end of the conduit, and for disposing the bleeder means into the opened position when the body is at the other end of the conduit; and, initiating means for selectively urging the sealing means into radial expansion.

2. The valving member of claim 1 wherein the initiating means comprises linkage means for urging the sealing means into radial expansion in response to a presence of the body at the first end of the conduit.

3. The valving member of claim 1 wherein the bleeder control means comprises:

sensing means for sensing the body at the first end and at the other end; and, connecting means for connecting the sensing means to the bleeder means to i) urge the bleeder means into the closed position when the body is sensed at the first end, and ii) urge the bleeder means into the opened position when the body is sensed at the other end.

4. The valving member of claim 3 wherein the initiating means is connected to the sensing means.

5. The valving member of claim 1 wherein the initiating means comprises:

indicating means received into the body for indicating the body at the first end and at the other end as a first and second longitudinal position, respectively; and, translation means for translating the first and second longitudinal positions of the indicating means into transverse radial motion of the sealing means.

6. The valving member of claim 5 wherein the indicating means is a shaft slidably received into the body and having an overall length greater than the overall length of the body, and wherein the translation means comprises a ramped annulus fixedly received over the shaft within the body and a pin in the transverse radial axis responsive to the annulus to drive the sealing means into sealing engagement with the inner wall.

7. A valving member for use with a well producing fluids under pressure through a product conduit having an inner wall, the member comprising:

a body slidable within the production conduit, the body having a longitudinal axis, a transverse radial axis orthogonal to the longitudinal axis, and an internal passageway;

a radially expansible sealing means attached to the body for selectively circumferentially sealing the production conduit against a first flow of said fluids between the body and the inner wall, the sealing means comprising an elastomeric layer circumferentially disposed over a portion of the body to sealingly engage the inner wall of the conduit when expanded and to avoid engaging the wall when not expanded;

bleeder means for permitting a second flow of said fluids through the internal passageway when in an opened position, and for restricting the second flow of the fluids through the passageway when in a closed position;

bleeder control means for selectively disposing the bleeder means into the closed position when the body is at a first end of the conduit, and for disposing the bleeder means into the opened position when the body is at the other end of the conduit; and, initiating means for selectively urging the sealing means into radial expansion, the initiating means comprising linkage means for urging the sealing means into radial expansion in response to a presence of the body at the first end of the conduit.

8. A valving member according to claim 7 wherein the bleeder control means comprises:

sensing means for sensing the body at the first end and at the other end; and, connecting means connecting the sensing means to the bleeder means for i) urging the bleeder means into the closed position when the body is sensed at the first end, and ii) urging the bleeder means into the opened position when the body is sensed at the other end.

9. A valving member according to claim 8 wherein the initiating means is connected to the sensing means.

10. A valving member according to claim 7 wherein the initiating means comprises:

indicating means received into the body for indicating the body at the first end and at the other end as a first and second longitudinal position, respectively; and, translation means for translating the first and second longitudinal positions of the indicating means into transverse radial motion of the sealing means.

11. The valving member of claim 10 wherein the indicating means is a shaft slidably received into the body and having an overall length greater than the overall length of the body, and wherein the translation means comprises a ramped annulus fixedly received over the shaft within the body and a pin in the transverse radial axis responsive to the annulus to drive the sealing means into sealing engagement with the inner wall.

12. An apparatus for use with a generally cylindrical gas and oil well tool slidable within a production well conduit and having an internal passageway and a longitudinally slidable rod extending from end-to-end and beyond the tool, the apparatus comprising:

a resilient radially expansible elastomeric layer means disposed over a portion of the tool for uninterrupted circumferential sealing engagement with an inner wall of said production well conduit when in an expanded condition and for avoiding engaging the inner wall when in a relaxed condition;

mechanical force transmitter means, connecting the expansible elastomeric layer means with the longitudinally slidable rod, for radially urging the expansible elastomeric layer to said expanded condition when the longitudinally slidable rod is at a first position within the tool and for permitting the expansible elastomeric layer means to contract to said relaxed condition avoiding engaging the inner wall when the longitudinally slidable rod is at a second position within the tool;

bleeder means, cooperatively associated with said longitudinally slidable rod and said tool, for opening to permit a fluid flow through said internal passageway and closing to restrict said fluid flow through said internal passageway; and, bleeder control means for opening said bleeder means permitting said fluid flow through said internal passageway when said tool is at a first end of said production well conduit, and closing said bleeder means restricting said fluid flow through said internal passageway when said tool is at a second end of said production well conduit.

13. The apparatus of claim 12 wherein the mechanical force transmitter means further comprises:

at least one radially extending pin interposed between said rod and said expansible elastomeric layer means;

motion converting means, interposed between the rod and the radially extending pin, for converting longitudinal motion of the rod to radial motion of the pin; and, pin return means for urging the at least one radially extending pin towards the motion converting means.

14. The apparatus of claim 13 further comprising a plurality of radially extending pins connected to force distributing plates, the pins and plates being interposed between the rod and the expansible elastomeric layer means.

15. The apparatus of claim 12 wherein the mechanical force transmitter means further comprises:

radial expansion means, interposed between said rod and said expansible elastomeric layer means, for substantially uniformly radially expanding the elastomeric layer means;

motion converting means, interposed between the rod and the radial expansion means, for converting longitudinal motion of the rod to radial motion of the radial expansion means; and, return means for urging the radial expansion means against the motion converting means.

16. The apparatus of claim 12 wherein the expansible elastomeric layer means is responsive to pressure within said production well conduit to radially expand in a presence of fluid pressure below the tool and radially contract in an absence of the pressure.

17. The apparatus according to claim 12 wherein said elastomeric layer means comprises at least one circumferentially disposed outwardly extending sealing lip means for sealingly engaging said inner wall when said mechanical force transmitter means is in said first position within the tool.

18. The apparatus according to claim 17 wherein said sealing lip means includes energizing means for energizing said lip against said inner wall responsive to fluid pressure within said production well conduit.

19. The apparatus according to claim 18 wherein the energizing means includes a circumferential undercut groove in said sealing lip means for increasing the flexibility of said lip means and rendering the lip means responsive to said fluid pressure for outward radial expansion against said inner wall.

20. The apparatus according to claim 12 wherein said elastomeric layer means comprises a plurality of circumferentially disposed outwardly extending sealing lip means for sealingly engaging said inner wall when said mechanical force transmitter means is in said first position within the tool.

21. The apparatus according to claim 20 wherein said plurality of sealing lip means are longitudinally disposed on said tool over a predetermined distance at least greater than a distance between ends of tubing sections at coupling joints of said production well conduit.

22. An automatic control system for use with a well producing fluids under pressure through a conduit and a sales line comprising:

an interface tool comprising:

a body slidable within the conduit having a longitudinal axis, a transverse radial axis orthogonal to the longitudinal axis and an internal passageway;

a radially expansible sealing means attached to the body for selectively circumferentially sealing the conduit against a first flow of said fluids between the body and an inner wall of the conduit, the sealing means comprising an elastomer layer circumferentially disposed over a portion of the body to sealingly engage the inner wall of the conduit when expanded and to avoid engaging the wall when not expanded;

bleeder means for permitting a second flow of said fluids through the internal passageway when in an opened position, and for restricting the second flow of the fluids through the passageway when in a closed position;

bleeder control means for selectively disposing the bleeder means into the closed position when the body is at a first end of the conduit, and for disposing the bleeder means into the opened position when the body is at the other end of the conduit; and, initiating means for selectively urging the sealing means into radial expansion, the initiating means comprising linkage means for urging the sealing means into radial expansion in response to a presence of the body at the first end of the conduit;

pressure sensing means for sensing a fluid pressure within the conduit and for generating a conduit pressure signal;

interface tool catch means for selectively holding the tool at a first end of the conduit and having means for releasing the interface tool in response to a tool release signal;

tool arrival sensing means for sensing the tool at the first end of the conduit and for generating a tool arrival signal;

sales valve means responsive to a sales valve close signal and to a sales valve open signal for respectively restricting and permitting flow of the fluids through the sales line; and, an intelligent controller responsive to the conduit pressure signal for generating the sales valve open signal when the fluid pressure is at a first predetermined level and for generating the tool release signal when the fluid pressure is at a second predetermined level.

23. The automatic control system of claim 22 wherein the controller comprises means for simultaneously generating the sales valve close signal and the tool release signal when the fluid pressure is at the second predetermined level.

24. The automatic control system of claim 23 wherein the controller comprises timer means for timing a presence of the tool arrival signal as a count value, and means for simultaneously generating the sales valve close signal and the tool release signal when the fluid pressure is at the second predetermined level and the count value reaches a first predetermined time value.

25. A method of operating a gas and oil well system having a conduit connecting a producing formation and a storage tank, a sales valve between the tank and the formation, a pressure transducer for sensing pressure within the conduit between the sales valve and the formation, an interface tool slidable within the conduit, and a tool catcher for selectively holding the tool, the method comprising the steps of:

opening an internal valve in the tool and contracting a circumferential seal on said tool away from contacting an inner wall of said conduit when the tool is at the catcher;

closing the sales valve and releasing the tool from the tool catcher into the conduit when the pressure transducer senses a first pressure in the conduit allowing the tool to fall within the conduit toward the formation;

closing the internal valve and expanding the circumferential seal to contact the inner wall of said conduit by a mechanical linkage initiated when the tool arrives at the formation;

opening the sale valve when the pressure transducer senses a second pressure different from the first pressure in the conduit to cause the tool to raise the accumulated fluids;

catching the tool in the tool catcher, and;

holding the tool in the catcher while the pressure transducer senses a changing pressure in the conduit different from the first pressure and different from the second pressure.

26. The method of claim 25 wherein the steps of opening an internal valve through holding are repeated cyclically.

27. The method of claim 25 further comprising the steps of:

opening said internal valve when the tool is held in the catcher, and;

closing the valve when the tool reaches an extreme end of the conduit at the formation.

28. The method of claim 27 further comprising the steps of:

contracting the circumferential seal of the tool to a contracted position when the tool is held in the catcher, and;

wherein the opening of the internal valve is initiated by the mechanical linkage.

29. The method of claim 28 further comprising the steps of:

maintaining the circumferential seal in the contracted position away from contacting the conduit when the tool descends into the conduit from the catcher towards the formation; and;

maintaining the circumferential seal in the expanded position contacting the conduit when the tool ascends the conduit from the formation towards the catcher.

30. An apparatus slidable within a well production conduit connecting a fluid producing formation with a collecting device, the apparatus comprising:

a substantially cylindrical body member having an internal passageway therethrough;

a radially expansible sealing means attached to the body for selectively circumferentially sealing the production conduit against a first flow of said fluids between the body and an inner wall of the conduit, the sealing means comprising an elastomeric layer circumferentially disposed over a portion of the body to sealingly engage the inner wall of the conduit when expanded and to avoid engaging the wall when not expanded;

bleeder means for permitting a second flow of said fluids through the internal passageway when in an opened position, and for restricting the second flow of the fluids through the passageway when in a closed position;

first urging means for selectively urging the sealing means into radial expansion when the body is at first predefined position in said well production conduit and selectively allowing radial contraction when the body is at a second predefined position in said well production conduit;

second urging means for selectively urging the bleeder means into the closed position when the body is at a third predefined position in said well production conduit, and urging the bleeder means into the opened position when the body is at a fourth predefined position in said well production conduit.

31. An apparatus according to claim 30 further comprising:

first maintaining means for selectively respectively maintaining the sealing means in said radial expansion and the bleeder means in said the closed position responsive to said first and second urging means; and, second maintaining means for selectively respectively maintaining the sealing means in said radial contraction and the bleeder means in said open position responsive to said first and second urging means.

32. An apparatus according to claim 30 further comprising means for connecting said first and second urging means wherein said first and third predefined positions in said well production conduit are coincident and wherein said second and fourth predefined positions in said well production conduit are coincident.

33. An apparatus according to claim 31 further comprising means for connecting said first and second maintaining means wherein said first and third predefined positions in said well production conduit are coincident and wherein said second and fourth predefined positions in said well production conduit are coincident.

34. An apparatus according to claim 33 further comprising means for connecting said first and second maintaining means.

35. An apparatus according to claim 32 further comprising:

first maintaining means for selectively respectively maintaining the sealing means in said radial expansion and the bleeder means in said the closed position responsive to said first and second urging means; and, second maintaining means for selectively respectively maintaining the sealing means in said radial contraction and the bleeder means in said open position responsive to said first and second urging means.

36. An apparatus according to claim 35 further comprising means for connecting said first and second maintaining means.

37. A production tool apparatus slidable within a well production conduit connecting a fluid producing formation with a fluid collection device, the apparatus comprising:

a substantially cylindrical body member;

a radially expansible sealing means attached to the body member for selectively circumferentially sealing the production conduit against a first flow of said fluid between the body member and said conduit, the sealing means comprising an elastomeric layer circumferentially disposed over a portion of the body to continuously sealingly engage the inner wall of the conduit when expanded and to avoid engaging the wall when not expanded;

urging means for selectively urging the sealing means into radial expansion when the body is at a first predetermined position in said well production conduit and selectively allowing radial contraction when the body is at a second predefined position in said well production conduit;

means defining a fluid passage in said apparatus;

valve means for selectively permitting a second flow of said fluid through said passage; and, valve control means for actuating said valve means open when said tool apparatus is at said second predetermined position in said well production conduit to permit said second flow and actuating said valve means closed when said tool apparatus is at said first predetermined position in said well production conduit to restrict said second flow.

38. An apparatus according to claim 37, wherein said sealing means comprises a plurality of circumferentially disposed radially outwardly extending elastomeric sealing lip means for sealingly engaging said inner wall when said urging means selectively urges the sealing means into said radial expansion.

39. An apparatus according to claim 38 wherein said plurality of sealing lip means are longitudinally disposed on said body member over a predetermined distance at least greater than a distance between ends of tubing sections at coupling joints forming said well production conduit.

* * * * *